United States Patent [19]

Laufhütte et al.

[11] Patent Number: 4,663,134

[45] Date of Patent: May 5, 1987

[54] METHOD AND DEVICE FOR FINE DESULFURIZATION OF COKE OVEN GAS

[75] Inventors: Dieter Laufhütte, Recklinghausen; Klaus Schüpphaus, Herten; Günter Trowe, Hamm; Wolf D. Kosske, Dortmund; Friedrich Hübel, Castrop-Rauxel, all of Fed. Rep. of Germany

[73] Assignee: Firma Carl Still GmbH & Co. KG, Fed. Rep. of Germany

[21] Appl. No.: 731,109

[22] Filed: May 6, 1985

Related U.S. Application Data

[60] Continuation-in-part of Ser. No. 594,108, Mar. 28, 1984, abandoned, which is a division of Ser. No. 486,085, Apr. 18, 1983.

[30] Foreign Application Priority Data

Apr. 24, 1982 [DE] Fed. Rep. of Germany ..... 3215333

[51] Int. Cl.[4] ..... C01B 17/16

[52] U.S. Cl. ..... 423/220; 423/234; 55/93

[58] Field of Search ..... 423/220, 234; 55/48, 55/51, 70, 73, 93, 94

[56] References Cited

U.S. PATENT DOCUMENTS

| | | | |
|---|---|---|---|
| 2,596,692 | 5/1952 | Jordan | 55/73 |
| 3,104,959 | 9/1963 | Grosskinsky et al. | 55/48 |
| 3,200,066 | 8/1965 | Scoggin | 208/342 |
| 3,245,752 | 4/1966 | Fryar et al. | 423/224 |
| 3,728,441 | 4/1973 | Hamblin | 423/220 |
| 3,880,617 | 4/1975 | Shibuya et al. | 55/94 |
| 4,138,230 | 2/1979 | Thompson | 423/220 |
| 4,254,094 | 3/1981 | Hegarty | 423/220 |
| 4,395,385 | 7/1983 | Welsh | 423/234 |
| 4,477,420 | 10/1984 | Bauer et al. | 423/234 |
| 4,499,060 | 2/1985 | Ritter et al. | 423/234 |
| 4,514,194 | 4/1985 | Järvenpää | 55/94 |
| 4,518,572 | 5/1985 | Ritter | 423/234 |
| 4,519,991 | 5/1985 | Oliveau et al. | 423/220 |
| 4,585,630 | 4/1986 | Kent et al. | 423/234 |

FOREIGN PATENT DOCUMENTS

| | | | |
|---|---|---|---|
| 3215333 | 11/1983 | Fed. Rep. of Germany | 423/234 |

*Primary Examiner*—Andrew H. Metz
*Assistant Examiner*—Anthony McFarlane
*Attorney, Agent, or Firm*—McGlew and Tuttle

[57] ABSTRACT

A method and apparatus for removing hydrogen sulfide from crude coke oven gas comprises initially scrubbing the crude coke oven gas in a low pressure scrubber using an aqueous regeneratable liquor. The gas is subsequently scrubbed in a high pressure scrubber using the same liquor. Streams of spent washing liquor are united and supplied to a regenerating unit where the hydrogen sulfide is removed in the form of sulfur or sulfuric acid. After the regenerating unit the liquor is returned to the high and low pressure scrubbers.

9 Claims, 1 Drawing Figure

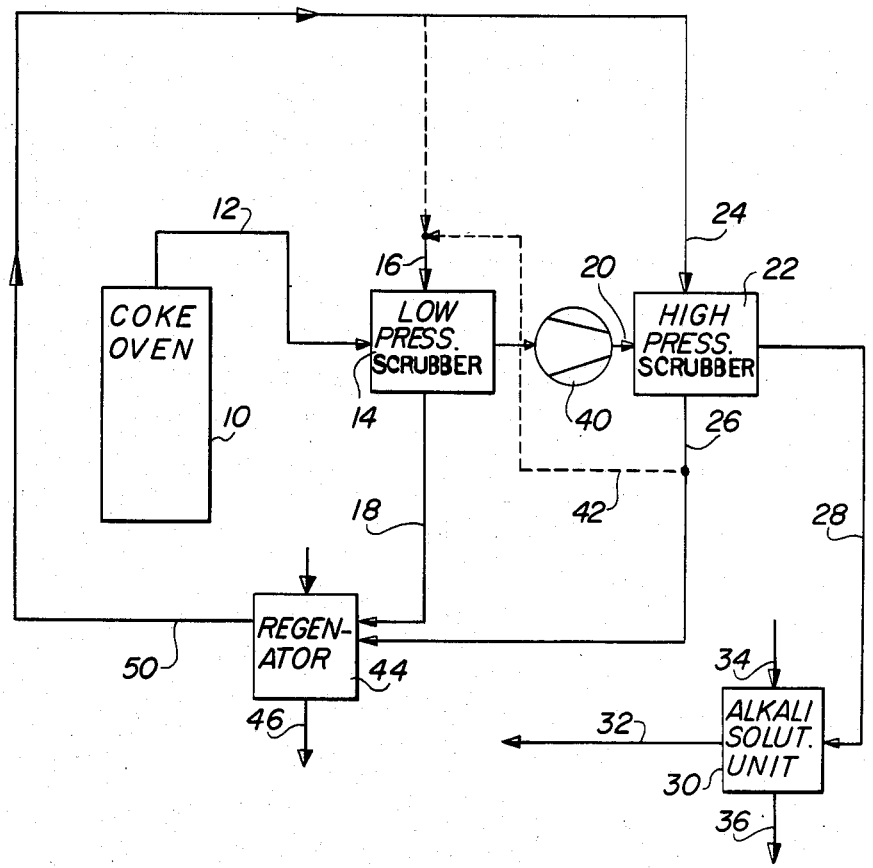
COKE OVEN
LOW PRESS. SCRUBBER
HIGH PRESS. SCRUBBER
REGEN-ATOR
ALKALI SOLUT. UNIT
10
12
14
16
18
20
22
24
26
28
30
32
34
36
40
42
44
46
50

METHOD AND DEVICE FOR FINE DESULFURIZATION OF COKE OVEN GAS

CROSS-REFERENCE TO RELATED APPLICATION

This is a continuation-in-part application of Ser. No. 594,108 filed Mar. 28, 1984,now abandoned, which is a divisional application of Ser. No. 486,085 filed Apr. 18, 1983, now pending.

FIELD AND BACKGROUND OF THE INVENTION

The present invention relates in general to coke oven processes and in particular to a new and useful method of removing hydrogen sulfide from crude coke oven gas.

The coke oven gas produced during the carbonization of coal must be subjected to various purifying treatments before using it for underfiring, for a city gas system, or for other purposes. More particularly, it is usual to desulfurize the coke oven gas in a low pressure process, to prevent corrosion and protect the environment. Such scrubbing processes with all their advantages and disadvantages are described and shown in Ullmann's Encyclopedia of Chemical Technology, Volume 10, Third Edition, March 1958, Pages 307 to 322. According to this digest, of the entire amount of coke oven gas produced in a coking plant, 95% is usually desulfurized in a so-called wet process under normal pressure, and only the remaining percentages, which is not needed in the plant itself for underfiring, for example, is further desulfurized to a quality high enough for city gas. This is done under pressure in various "wet processes", while employing liquid scrubbing agents, or in dry processes, such as with the use of bog iron ore or residuals from bauxite working processes (see Ullmann's Encyclopedia, Vol. 10, pages 307, 308 and 314).

Different methods with different scrubbing agents are employed for the preliminary cleaning under normal pressure, and the subsequent cleaning under higher pressure. Considerable costs must thus be incurred to treat and regenerate the different scrubbing agents in cycling processes which are needed for reasons of economy. With a subsequent dry cleaning with bog iron ore and similar substances suitable for absorption, it is increasingly difficult to procure them in amounts sufficient for the huge gas column to be treated. In addition, the methods of regenerating such sulfur-enriched substances and of recovering sulfur in such regeneration plants are uneconomical.

SUMMARY OF THE INVENTION

The present invention is directed to a method of the above-mentioned kind which permits the cleaning of the entire amount of crude coke oven gas from a coke oven with a single kind of operation, and to make the regeneration inexpensive.

Accordingly an object of the present invention is to provide a method and apparatus of removing hydrogen sulfide from crude coke oven gas which comprises initially scrubbing the coke oven gas with a regenerable aqueous washing liquor in a normal or low pressure scrubbing system, subsequently scrubbing the coke oven gas with the same washing liquor in a pressurized or high pressure scrubber system, uniting the washing liquor streams which are enriched with sulfur from the low and high pressure scrubber systems into a united stream, conjointly treating and regenerating the united stream to form a regenerated liquor and distributing the regenerated liquor to the low and high pressure scrubber systems.

In accordance with the invention, only one washing agent is needed, so that the regneration also becomes substantially simplified and less expensive. It is surprising that the method manages with one and the same washing agent in systems under different pressure, without thereby creating additional problems of regeneration. In consequence, the method is not only simpler and more economical, but also easier to monitor.

A further object of the invention is to supply the washing liquor from the high pressure system, entirely or partially into the low pressure system. This may minimize the necessary additional energy supply, thus making the inventive method still more advantageous. Such an additional enrichment of the washing liquor from the pressurized system can easily be provided since the sulfur amounts still contained in the gas in the pressurized system are relatively low.

The sulfur content in the coke oven gas is further reduced by providing in accordance with the invention that the coke oven gas after being discharged from the high pressure scrubber is scrubbed with alkali solution. Preferably, a caustic soda solution is employed which, after scrubbing, is added to the ammoniacal gas liquor of the same or another coking plant, as an agent for decomposing the fixed ammonia compounds. The employed amount of caustic soda solution is always equal to, or smaller than, the amount needed for decomposing the fixed ammonia compounds in the ammoniacal liquor. When including the subsequent alkali solution scrubbing, the method offers the substantial advantage of insuring an always uniform and final desulfurization.

A further object of the invention is to provide a method of removing hydrogen sulfide from coke oven gas which initially has from about 5 to 10 grams $H_2S/Nm^3$, wherein the coke oven gas is scrubbed in the high pressure scrubber to reduce the $H_2S$ content to from about 2 mg to 60 mg hydrogen sulfide per normal cubic meter and subsequently to scrub the coke oven gas using an alkali solution. It is advisable in this connection to adjust a constant content of hydrocarbons in the coke oven gas supplied to the alkali solution stage.

To carry out the inventive method, an apparatus is provided comprising a plurality of scrubbers, wherein the hydrogen sulfide scrubber of the normal pressure and the pressurized systems and the caustic soda solution stage are combined to a processing unit. Advantageously, such units require little space and their monitoring and control are simplified. It is advisable to provide ammoniacal gas liquor or an alkali containing washing liquor as the desulfurizing agent of the normal pressure and the pressurized systems. Thus makes it possible to utilize conventional desulfurizing agents which are available in sufficient amounts in coking plants.

The invention provides a method which is easy to control, monitor and handle, and in which the costs of regenerating the used washing liquors are substantially reduced.

A further object of the invention is to provide an apparatus which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

BRIEF DESCRIPTION OF THE DRAWING

The only drawing in the case is a block diagram showing a system used in accordance with the invention.

DESCRIPTION OF THE PREFERRED EMBODIMENT

Referring to the drawing in particular, the invention embodied therein comprises a method and apparatus of removing hydrogen sulfide from coke oven gas which leaves a coke oven 10 over a line 12. As is known, coke oven gas leaving coke oven 10 has a usual hydrogen sulfide content of from about 5 to 10 grams per $Nm^3$, and particularly 6 to 8 grams per $Nm^3$. The gas is first provided to a low or ambient pressure scrubber 14 (operating near 1 Atm. pressure) where it is subjected to scrubbing in the normal low pressure environment by regenerable aqueous washing liquor, in particular) ammoniacal gas liquor or alkali containing washing liquor supplied by line 16 and leaving scrubber 14 on line 18. The coke oven gas then passes over line 20 to a pressurized or high pressure scrubber 22 which operates at about 6 to 12 bar. In scrubber 22, the coke oven gas is again subjected to the same type of washing liquor provided to scrubber 14, on line 21. After removing additional hydrogen sulfide from the coke oven gas, the liquor leaves scrubber 22 over line 26. In accordance with one development of the invention, the gas having relatively low hydrogen sulfide content is supplied over a line 28 from the output of scrubber 22 to an alkali solution scrubber 30 which removes additional hydrogen sulfide from the gas which is now available at line 32. Alakli solution enters unit 30 over line 34 and leaves unit 30 over line 36.

The coke oven gas on line 20 between low and high pressure scrubbers 14, 22 is pressurized for example by compressor 40.

According to one feature of the invention, a portion or all of the washing liquor leaving high pressure scrubber 22 on line 26 may be supplied over a branch line 42, to line 16 to form the washing liquor stream for low pressure scrubber 14. The streams of washing liquor are united to form a single stream which is regenerated in a regenerator 44 where the hydrogen sulfide is removed from the washing liquor in the form of sulfur or sulfuric acid on line 46. The output line 50 of regenerator 44 is connected to either inlet line 24 of high pressure scrubber 22, inlet line 16 of scrubber 14, or both for supplying regenerator washing liquor to the scrubbers.

EXAMPLE

In a coking plant, 100,000 $Nm^3$/hour of coke oven gas, having a usual $H_2S$ content, are desulfurized in a wet process to a content of about 0.5 grams of $H_2S/Nm^3$ (normal cubic meters). Of the entire amount, 45,000 $Nm^3$ per hour are branched off after the lower pressure desulfurization, to be used in the plant for underfiring, while the remaining 55,000 $Nm^3$/hour are compressed to 6 to 12 bar and subjected in a subsequent hydrogen sulfide scrubber to fine desulfurization to almost 2 mg of $H_2S/Nm^3$, by means of a partial stream of the same washing liquor which was used in the low pressure desulfurization. It is also possible, of course, to desulfurize the entire amount of coke oven gas to this extent. As is known, the usual $H_2S$ content of coke oven gas from plant 10 is initially high. Usual values are 5 to 10 grams $H_2S/Nm^3$ and particularly 6 to 8 grams $H_2S/Nm^3$, initially.

The washing liquor streams from the low pressure system and the pressurized system are then treated in a common regeneration plant, and the hydrogen sulfide is removed in the form of sulfur or sulfuric acid. To obtain the required guaranteed desulfurization of less than 2 mg of $H_2S/Nm^3$ under any operating condition, the residual hydrogen sulfide content is removed from the gas by means of a caustic soda solution in a subsequent scrubbing stage which is provided in the same or in a following column. The enriched soda solution is then added to the ammoniacal liquor as an agent for decomposing the fixed ammonia compounds and the hydrogen sulfide thereby set free is again recovered as sulfur or sulfuric acid. Experience has taught that the amount of soda solution is always equal to or less than that necessary for decomposing the fixed ammonia compounds present in the ammoniacal liquor.

It has further been found that instead of the system for circulating ammoniacal liquor and an alkali containing washing liquor, potash or oxidation scrubbers in cyclic operation may also be employed for the desulfurization under both normal and excess pressure. Depending on the concentration and quality of the desulfurization agent added at the pressure site, the hydrogen sulfide content can be adjusted, ahead of the subsequent soda solution stage, to a constant amount between less than 2mg of $H_2/Nm^3$ and about 60 mg of $H_2S/Nm^3$. The low content of $H_2S$ is needed to insure the desired residual desulfurization in the soda solution stage with the available soda solution amount.

While a specific embodiment of the invention has been shown and described in detail to illustrate the application of the principles of the invention, it will be understood that the invention may be embodied otherwise without departing from such primciples.

What is claimed is:

1. A method of removing hydrogen sulfide from crude coke oven gas having a initial hydrogen sulfide content of about 5 to 10 grams of $H_2S/Nm^3$, comprising: initially scrubbing the crude coke oven gas with an aqueous regenerable washing liquor in a low pressure scrubber; supplying the coke oven gas from the low pressure scrubber to a high pressure scrubber; subsequently scrubbing the coke oven gas only with a fresh stream of the same washing liquor in the high pressure scrubber at a pressure of about 6 to 12 bar; discharging a washing liquor stream from both the low and high pressure scrubbers; uniting the washing liquor streams which are enriched with hydrogen sulfide, from the low and high pressure scrubbers into a united stream; conjointly treating and regenerating the united stream to form a regenerated liquor; and distributing the regenerated liquor to the low pressure and high pressure scrubber.

2. A method according to claim 1, wherein the washing liquor from the high pressure scrubber is directed at least partly into the low pressure scrubber for further enrichment with hydrogen sulfide.

3. A method according to claim 1, wherein the coke oven gas after being discharged from the high pressure scrubber is scrubbed with alkali solution.

4. A method according to claim 3, wherein the coke oven gas is scrubbed in the high pressure scrubber to have from about 2 mg to 60 mg of $H_2S/Nm^3$, and is subsequently scrubbed with alkali solution to reduce the $H_2S$ content to below 2 mg $H_2S/Nm^3$.

5. A method according to claim 1, wherein the coke oven gas is scrubbed in the high pressure scrubber to have from about 2 mg to 60 mg of $H_2S/Nm^3$.

6. Method of removing hydrogen sulfide from crude coke oven gas, which comprises initially scrubbing the coke oven gas with a first supply of an aqueous regenerable washing liquor in a low pressure scrubber to form a partially scrubbed gas and a hydrogen sulfide enriched first scrubber liquor, separately recovering the partially scrubbed gas and the hydrogen sulfide enriched first scrubber liquor from the low pressure scrubber, scrubbing the so recovered partially scrubbed gas from the low pressure scrubber with a second separate supply of said aqueous regenerable washing liquor in a high pressure scrubber at a pressure of about 6 to 12 bar to form a substantially scrubbed gas and a correspondingly hydrogen sulfide enriched second scrubber liquor, separately recovering the substantially scrubbed gas and the hydrogen sulfide enriched second scrubber liquor from the high pressure scrubber, combining the so recovered first and second scrubber liquors to form a combined scrubber liquor and regenerating the combined scrubber liquor to form a regenerated liquor, and recycling the regenerated liquor correspondingly to said low pressure scrubber and to said high pressure scrubber.

7. Method of claim 6 wherein at least a part of the second scrubber liquor is directed from the high pressure scrubber to the low pressure scrubber for further enrichment with hydrogen sulfide.

8. Method of claim 6 wherein the coke oven gas initially has a content of about 5 to 10 g $H_2S/Nm^3$, the partially scrubbed gas recovered from the low pressure scrubber has a content of about 0.5 g $H_2S/Nm^3$, and the scrubbed gas recovered from the high pressure scrubber has a content of from about 2 to 60 mg $H_2S/Nm^3$.

9. Method of claim 8 wherein the gas recovered from the high pressure scrubber is thereafter scrubbed with alkali solution to reduce the $H_2S$ content to below 2 mg $H_2S/Nm^3$.

* * * * *